US008037830B2

(12) United States Patent
Winter

(10) Patent No.: US 8,037,830 B2
(45) Date of Patent: Oct. 18, 2011

(54) CARTRIDGE

(76) Inventor: Udo Winter, Linz (AT)

( * ) Notice: Subject to any disclaimer, the term of this patent is extended or adjusted under 35 U.S.C. 154(b) by 173 days.

(21) Appl. No.: 12/083,319

(22) PCT Filed: Oct. 12, 2006

(86) PCT No.: PCT/AT2006/000421

§ 371 (c)(1),
(2), (4) Date: Apr. 9, 2008

(87) PCT Pub. No.: WO2007/040174

PCT Pub. Date: Apr. 19, 2007

(65) Prior Publication Data

US 2009/0064887 A1 Mar. 12, 2009

(30) Foreign Application Priority Data

Oct. 13, 2005 (AT) ..... 1674/2005

(51) Int. Cl.
*F42B 5/26* (2006.01)

(52) U.S. Cl. ..... 102/470; 102/521; 102/522

(58) Field of Classification Search ..... 102/470, 102/520–528, 430, 469
See application file for complete search history.

(56) References Cited

U.S. PATENT DOCUMENTS

| | | | | | |
|---|---|---|---|---|---|
| 34,950 | A | * | 4/1862 | James | 102/520 |
| 178,595 | A | * | 6/1876 | Butler | 102/525 |
| 193,657 | A | * | 7/1877 | Hotchkiss | 102/525 |
| 214,843 | A | * | 4/1879 | Reilly | 102/526 |
| 1,166,360 | A | * | 12/1915 | Gregory | 102/430 |
| 2,247,563 | A | * | 7/1941 | Spalding | 102/523 |
| 2,669,930 | A | * | 2/1954 | Darby et al. | 102/523 |
| 2,982,212 | A | * | 5/1961 | Robinson, Jr. | 102/211 |
| 2,991,719 | A | * | 7/1961 | Millar | 102/523 |
| 2,993,444 | A | * | 7/1961 | Hablutzel | 102/523 |
| 3,055,268 | A | * | 9/1962 | Rosenthal | 89/1.1 |
| 3,164,092 | A | * | 1/1965 | Reed et al. | 102/522 |
| 3,242,866 | A | * | 3/1966 | Malter | 102/506 |
| 3,318,244 | A | | 5/1967 | Rostocil | |
| 3,394,905 | A | * | 7/1968 | Rapp | 244/3.23 |
| 3,431,815 | A | * | 3/1969 | Kaufmann, Jr. | 89/1.1 |

(Continued)

FOREIGN PATENT DOCUMENTS

DE 26 30 830 1/1978

(Continued)

OTHER PUBLICATIONS

International Search Report.

*Primary Examiner* — Michelle Clement
(74) *Attorney, Agent, or Firm* — Collaid & Roe, P.C.

(57) ABSTRACT

A cartridge is described having a cartridge casing (1) and having a propellant cup (4), which is inserted in the cartridge casing (1), receives a sub-caliber projectile (5) in a formfitting manner, and is manufactured from plastic, and which separates the projectile (5) from the propellant charge in the cartridge casing (1) and has axial separation points (15) along its jacket (10). To ensure an advantageous length for the projectile, it is suggested that the propellant cup (5) have at least one pocket (9), extending in a cavity between the projectile (5) and the cartridge casing (1) and/or in a cavity of the projectile (5) and open toward the base (2) of the cartridge casing (1), for receiving a part of the propellant charge.

18 Claims, 9 Drawing Sheets

U.S. PATENT DOCUMENTS

| | | | | | |
|---|---|---|---|---|---|
| 3,496,869 | A | * | 2/1970 | Engel | 102/522 |
| 4,142,467 | A | * | 3/1979 | Stahlmann et al. | 102/523 |
| 4,175,493 | A | * | 11/1979 | Daily | 102/520 |
| 4,177,733 | A | * | 12/1979 | Romer et al. | 102/503 |
| 4,249,466 | A | * | 2/1981 | Rossmann et al. | 102/513 |
| 4,434,718 | A | | 3/1984 | Kopsch et al. | |
| 4,444,114 | A | | 4/1984 | Bisping et al. | |
| 4,542,696 | A | | 9/1985 | Bisping et al. | |
| 4,643,099 | A | * | 2/1987 | Luther et al. | 102/517 |
| 4,709,638 | A | * | 12/1987 | Broden et al. | 102/522 |
| 4,846,068 | A | * | 7/1989 | Zedrosser | 102/430 |
| 4,936,220 | A | | 6/1990 | Burns et al. | |
| 4,953,466 | A | | 9/1990 | von Gerlach | |
| 4,974,517 | A | * | 12/1990 | Kraft et al. | 102/521 |
| 5,090,328 | A | * | 2/1992 | Theis et al. | 102/522 |
| 5,157,224 | A | * | 10/1992 | Desevaux et al. | 102/434 |
| 5,189,251 | A | * | 2/1993 | Puckett | 102/457 |
| 5,192,830 | A | * | 3/1993 | Puckett | 102/457 |
| 5,214,238 | A | * | 5/1993 | Young | 102/520 |
| 5,339,743 | A | | 8/1994 | Scarlata | |
| 5,359,938 | A | * | 11/1994 | Campoli et al. | 102/521 |
| 5,404,816 | A | * | 4/1995 | Burri | 102/523 |
| 5,415,102 | A | * | 5/1995 | White | 102/522 |
| 5,710,391 | A | * | 1/1998 | Chetcuti | 102/430 |
| 5,804,759 | A | | 9/1998 | Sauvestre | |
| 6,073,560 | A | | 6/2000 | Stone | |
| 6,712,005 | B2 | * | 3/2004 | Heitmann | 102/439 |
| 6,895,865 | B2 | * | 5/2005 | Bond | 102/520 |
| 7,331,294 | B2 | * | 2/2008 | Mank | 102/524 |
| 7,451,705 | B2 | * | 11/2008 | Fry | 102/520 |
| 7,451,706 | B2 | * | 11/2008 | Meyer | 102/522 |
| 2001/0047736 | A1 | | 12/2001 | Thiesen | |
| 2003/0167957 | A1 | * | 9/2003 | Heitmann | 102/521 |
| 2004/0182274 | A1 | * | 9/2004 | Bond | 102/520 |
| 2006/0278114 | A1 | | 12/2006 | Millard | |
| 2007/0012212 | A1 | * | 1/2007 | Sheaffer | 102/457 |
| 2009/0151593 | A1 | * | 6/2009 | Winter | 102/521 |

FOREIGN PATENT DOCUMENTS

| | | |
|---|---|---|
| DE | 28 36 963 | 3/1984 |
| DE | 38 11 597 | 10/1989 |
| DE | 3 824 524 | 2/1990 |
| EP | 0 143 720 | 6/1985 |

* cited by examiner

CARTRIDGE

CROSS REFERENCE TO RELATED APPLICATIONS

This application is the National Stage of PCT/AT2006/000421 filed on Oct. 12, 2006, which claims priority under 35 U.S.C. §119 of Austrian Application No. A 1674/2005 filed on Oct. 13, 2005. The international application under PCT article 21(2) was not published in English.

FIELD OF THE INVENTION

The invention relates to a cartridge having a cartridge casing and having a propellant cup, inserted in the cartridge casing, receiving a sub-caliber projectile in a formfitting manner, and manufactured from plastic, which separates the projectile from the propellant charge in the cartridge casing and has axial separation points along its jacket.

DESCRIPTION OF THE PRIOR ART

To be able to fire sub-caliber projectiles from shotgun barrels, for example, inserting the projectile provided with guide vanes into a propellant cup, which is received together with the projectile by a cartridge casing, is known, inter alia (U.S. Pat. No. 4,434,718 A). The propellant cup has a base reinforced by a metal disk and a jacket enclosing the projectile, which is provided with axial intended breakpoints. If the propellant charge provided between the base of the cartridge casing and the propellant cup of such a cartridge inserted into the cartridge chamber of a shotgun is fired, the resulting propellant gases drive the propellant cup with the projectile out of the cartridge casing into the shotgun barrel, in which the sub-caliber projectile is guided via the propellant cup. Upon leaving the shotgun barrel, the jacket of the propellant cup is spread open by the air resistance and detaches from the projectile, which flies further. These known cartridges have the disadvantage above all that at a predefined length of the cartridge casing and a predefined quantity of propellant charge, the length of the sub-caliber projectile is limited, which has a disadvantageous effect on the precision of the flight path in spite of the tail unit of the projectile. In addition, the seal between the propellant cup and the shotgun barrel may be produced exclusively via a seal ring formed by the base of the propellant cup, which causes tolerance dependence. In spite of axial guide ribs of the jacket of the propellant cup, a centric guide of the projectile in the shotgun barrel may therefore not always be ensured.

SUMMARY OF THE INVENTION

The invention is therefore based on the object of designing a cartridge of the type described at the beginning in such a manner that not only may a projectile length advantageous for flight stability be ensured for the projectile, without having to accept reduced quantities of propellant charge, but rather also a centric guide of the projectile in the barrel is ensured independently of manufacturing tolerances.

The invention achieves the stated object in that the propellant cup has at least one pocket, which extends in a cavity between the projectile and the cartridge casing and/or in a cavity of the projectile and is open toward the base of the cartridge casing, for receiving a part of the propellant charge.

Because the propellant cup forms at least one pocket open toward the base of the cartridge casing, which extends over a longitudinal section of the projectile, a part of the propellant charge may be received in his pocket, so that the space required between the base of the cartridge casing and the projectile for receiving the propellant charge is reduced by the receptacle volume of the pocket of the propellant cup, and additional space is provided for lengthening the projectile. The requirement for this is at least one cavity exposed by the projectile, into which a pocket of the propellant cup may extend. The cavities may be provided in various ways and are essentially a function of the design of the projectile.

Especially advantageous conditions result in this context if the pockets of the propellant cup extend between axial guide vanes of the projectile. The groin space between the guide vanes allows the provision of pockets enclosing the projectile with rotational symmetry, which are terminated radially outward by the jacket of the propellant cup, so that the pressure of the propellant gases presses the jacket of the propellant cup radially outward against the barrel from which the projectile is fired. This signifies an advantageous seal of the propellant cup in relation to the barrel independently of manufacturing tolerances. In addition, the projectile is additionally centered in the propellant cup by the propellant gas pressure within the pockets of the propellant cup enclosing the projectile, which has an advantageous effect on the guide precision of the projectile. Moreover, the projectile is connected rotationally fixed to the propellant casing by the guide vanes, so that the projectile is given a twist upon firing from a rifled barrel, if the propellant gases press the jacket of the propellant cup against the rifling of the barrel.

Another possibility for providing space for a pocket of the propellant cup in the projectile area is to provide the projectile with a centric recess in the projectile base, into which the pocket of the propellant cup extends. Although forces which improve the seal effect may not be exerted via the propellant gases on the jacket of the propellant cup via such a pocket, improvement of the projectile guiding does result, because the projectile is centered in a formfitting manner in relation to the propellant cup in this pocket.

If the projectile tapers conically toward its base, the annular space remaining free between the conical projectile end and the jacket of the propellant cup may be used to implement a receptacle pocket in the form of an annular chamber, via which, after the firing of the propellant charge, the propellant cup is sealed in the barrel on one hand and the projectile is centered within the propellant cup on the other hand.

In barrels having a constricted muzzle opening, a largely unobstructed passage of the propellant cup through this choke opening is to be ensured. For this purpose, the propellant cup may have a jacket surface tapering forward having longitudinal ribs distributed around the circumference, whose envelope surface corresponds to an envelope cylinder of the propellant cup. In spite of the conical jacket surface, which eases the passage through the choke opening, a good guide of the propellant cup within the barrel results due to the longitudinal ribs distributed around the circumference, which taper off in a conical part of the jacket of the propellant cup so as not to endanger the seal between the propellant cup and the barrel in relation to the propellant gases. The longitudinal ribs of the jacket projecting beyond an axial section of the jacket surface may be sufficiently deformed because of the mutual lateral distances to allow the propellant cup to exit with the projectile from the barrel through the choke opening.

The projectile may have a setback annular shoulder on its head which is overlapped by the propellant cup, which not only ensures a secure axial hold of the projectile within the propellant cup, but rather also contributes to the flight stabilization of the projectile. In addition, the jacket of the propellant cup may be supported on this annular shoulder, to counter the danger of compression of the propellant cup as it is driven out of the barrel.

If the propellant cup is provided with at least one diaphragm, which terminates a centric overflow channel to the projectile and is broken through with the aid of the propellant gases, as the projectile is driven out of a barrel, propellant gases may reach the projectile base, for example, to ignite a tracer unit provided in the projectile or a delay fuse for a teargas charge. If the projectile forms a cavity adjoining the overflow channel, the gas pressure building up in this cavity as the projectile is driven out of the barrel may be used to detach the propellant cup more rapidly from the projectile after the exit from the barrel.

As already noted, the shape of the propellant cup is a function of the design of the projectile, which may be formed differently. It is thus possible for simple production of the projectile that the projectile forms a hollow body opened toward the propellant cup, which is folded into guide vanes, which dispenses with material-removing machining of the projectile to form the guide vanes. Especially advantageous conditions for various designs and/or adaptation of the projectile to various conditions result if the projectile comprises a head and a tail unit inserted in the hollow head, whose guide vanes extend into the head area, so that the tail unit may be combined with different projectile heads, possibly without having to perform adaptation of the propellant cup. The connection between the projectile head and the tail unit may preferably be achieved in that the head is folded clamped into the groin area between the guide vanes.

The projectile may additionally have a star-shaped cross-section deviating from a rotating body, which makes the shaping of separate guide vanes superfluous and provides a greater penetration effect. This star-shaped cross-section may be produced especially favorably in that the projectile comprises a tubular body, which is folded radially inward to form axial wings. To increase the projectile weight, in this embodiment, the remaining cavity of the folded-in tubular body may be at least partially filled up with a metal. Projectiles having a star-shaped cross-section require a propellant cup, whose pockets extending between the star-shaped wings of the projectile possibly have a reinforced base to be able to withstand the gas pressure.

To seal the propellant cup in relation to the barrel, the propellant cup may have at least one peripheral seal ring, upon whose formation the axial separation points of the jacket of the propellant cup extending into the seal area are to be taken into consideration if necessary, in that the seal ring forms sections guided around the rear ends of these separation points.

If the inner walls delimiting the pockets of the propellant cup taper off into a cutting edge toward the propellant charge, the penetration of the propellant cup into the propellant charge is made easier when the propellant cup having the projectile is inserted into the cartridge casings filled with the propellant charge. In addition, a deformation of this cutting edge may cause axial tolerance compensation between projectile and cartridge casing.

The jacket of the propellant cup does not need to extend beyond the axial length of the propellant cup. To provide a larger volume for the propellant charge, the inner walls delimiting the pockets of the propellant cup may project in the axial direction beyond the jacket of the propellant cup toward the base of the cartridge casing. Such an embodiment of the propellant cup causes a shorter guide length for the propellant cup, however, which has a noticeable disadvantageous effect in particular upon exit from the barrel. For this reason, the inner walls delimiting the pockets of the propellant cup may have axial guide ribs in extension of the jacket, which ensure an appropriate guide length for the propellant cup.

In order that the pressure of the propellant gases may advantageously be transmitted via the propellant cup to the projectile, the projectile may preferably be supported in the axial direction via damping elements on the base of the propellant cup, so that upon impingement of the propellant cup by the pressure of the propellant gases, a damped pressure transmission results due to a deformation of these ribs. These damping elements may comprise damping ribs provided on the base of the propellant cup and projecting toward the projectile. The damping ribs may additionally be used for axial tolerance compensation between propellant cup and projectile. A damped pressure transmission from the propellant cup to the projectile may also be achieved by a damping compound which partially fills up the pockets of the propellant cup, however.

BRIEF DESCRIPTION OF THE DRAWING

The subject matter of the invention is illustrated as an example in the drawings.

DESCRIPTION OF THE PREFERRED EMBODIMENT

Figure 1:
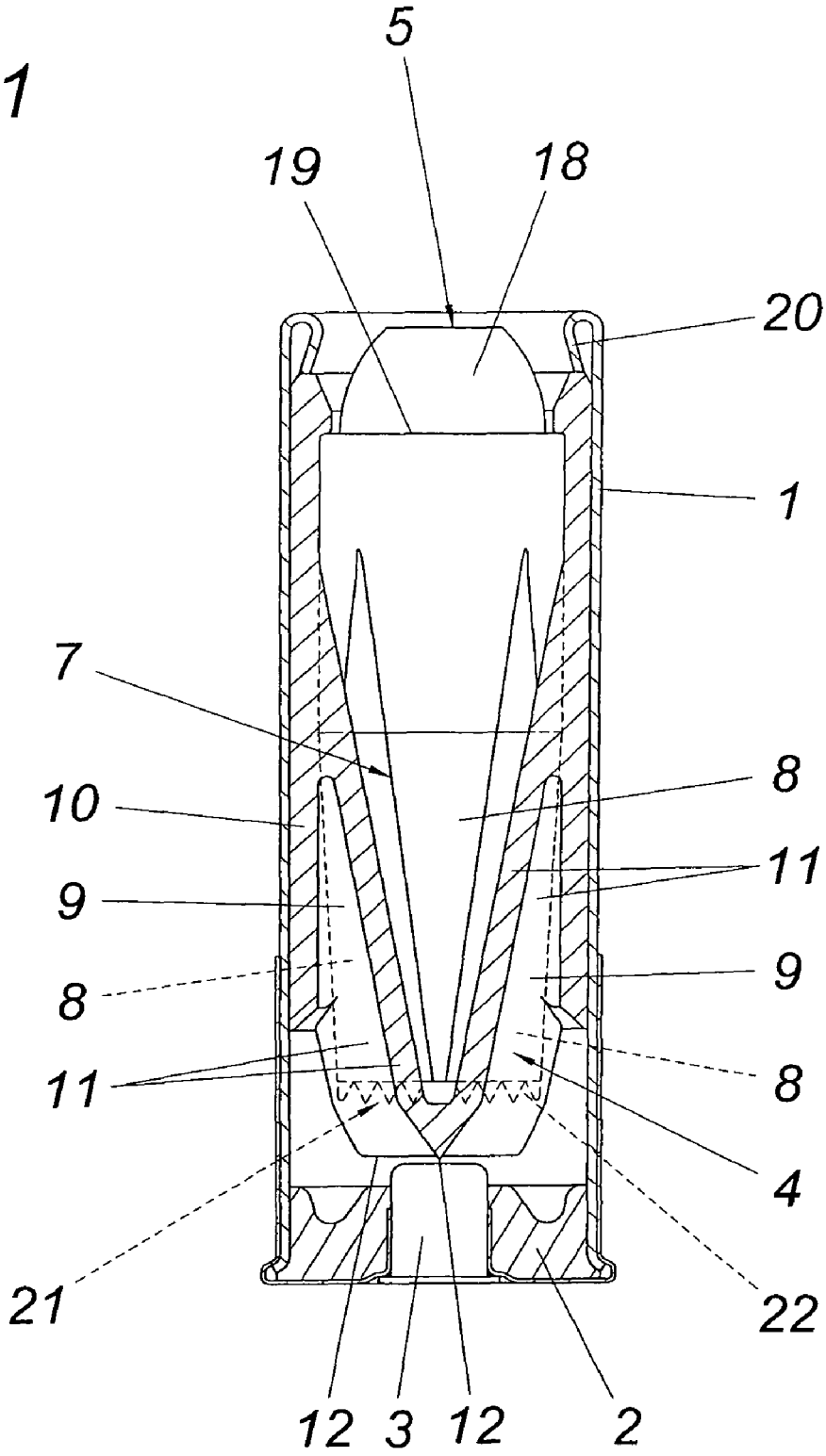
FIG. 1 shows a cartridge according to the invention in a simplified longitudinal section.

According to the preferred embodiment from FIGS. 1 through 4, the cartridge comprises a cartridge casing 1 having a base 2 and having a primer 3 inserted into the base 2, as well as a propellant cup 4, manufactured from plastic, for receiving a sub-caliber projectile 5. The propellant cup 4 encloses the projectile 5 in a formfitting manner, which has a projectile body 6, tapering toward the rear end, having a tail unit 7 in the form of radially projecting guide vanes 8, and forms pockets 9 extending into the groin area between the guide vanes 8 and open toward the base 2 of the cartridge casing 1, which are delimited on one side by a jacket 10 of the propellant cup 4 and on the other side by inner walls 11, which press against the projectile 5 and separate the projectile in relation to a propellant charge, which is provided in the cartridge casing 1 between the base 2 and the propellant cup 4 and fills up the pockets 9. However, this propellant charge is not shown in the drawing for reasons of clarity. In order that the propellant cup 4 may penetrate better into the propellant charge when it is pressed into the cartridge casing 1, the inner walls 11 delimiting the pockets 9 taper off into a cutting edge 12.

Figure 2:
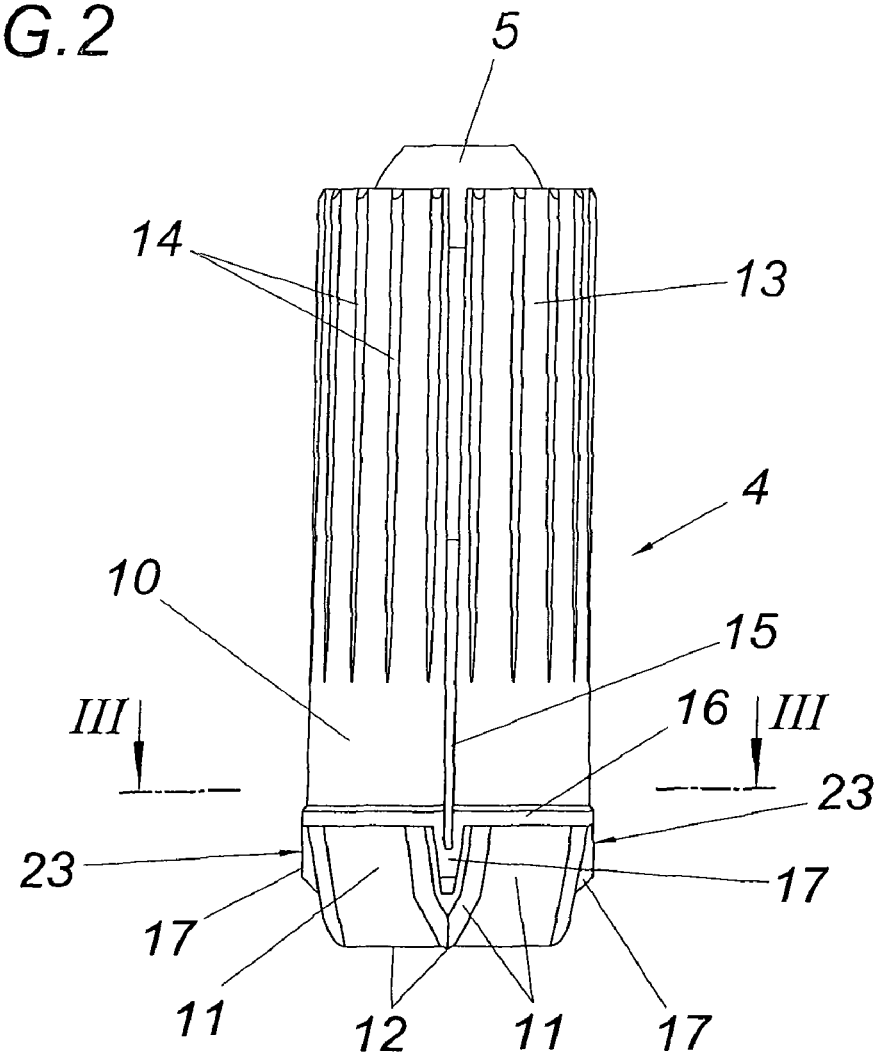
FIG. 2 shows the propellant cup having the projectile of the cartridge from FIG. 1 in a simplified side view.
Figure 3:
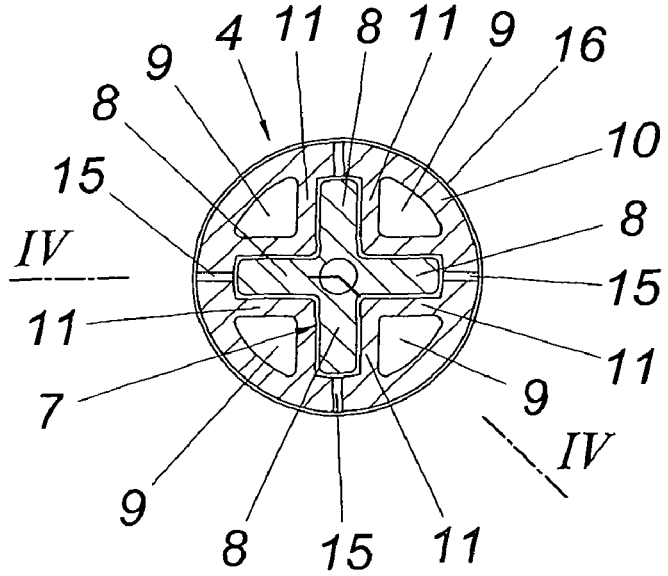
FIG. 3 shows a section along line III-III of FIG. 2.
Figure 4:
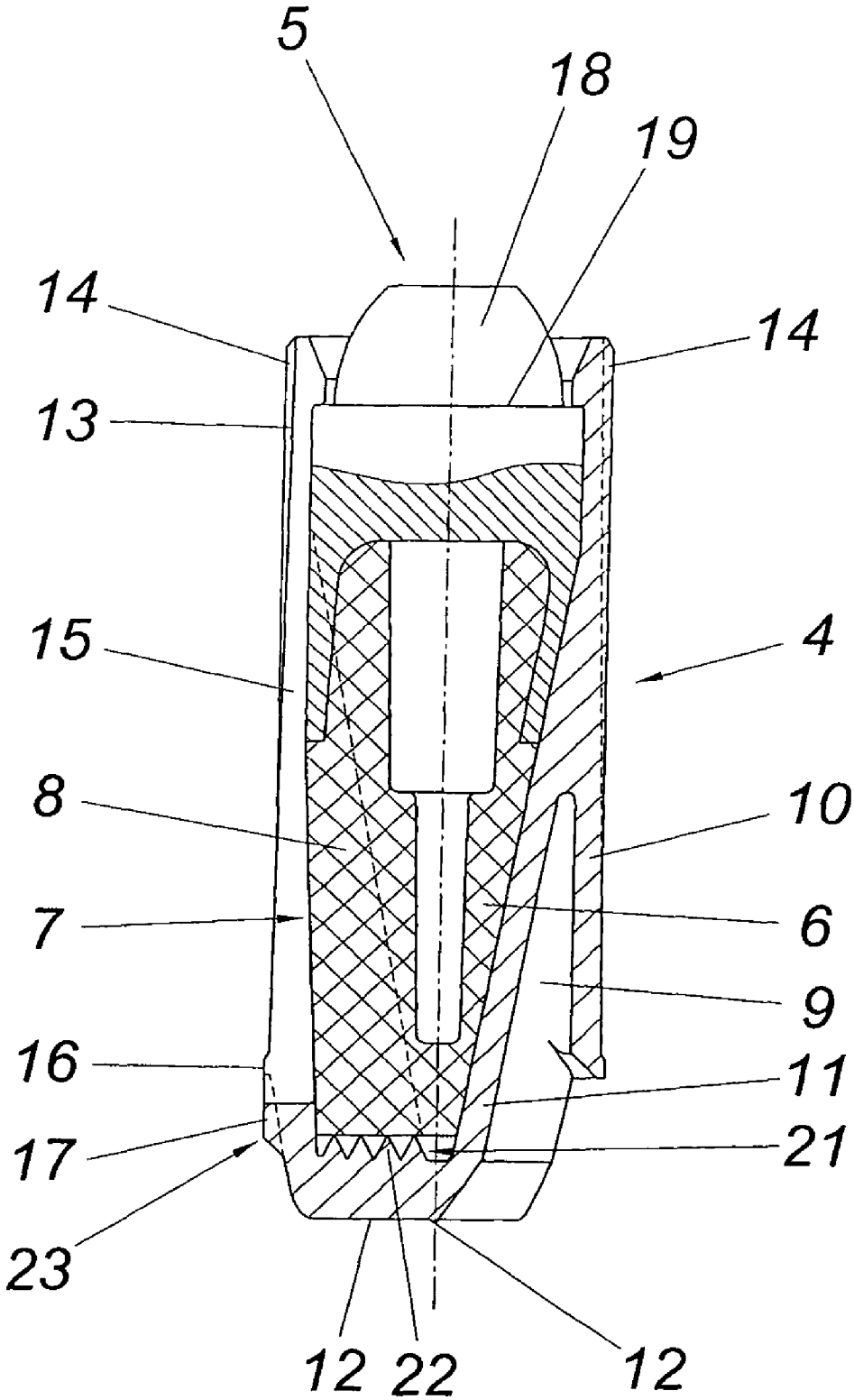
FIG. 4 shows a section along line IV-IV of FIG. 3.

The jacket 10 of the propellant cup 4 has a jacket surface 13 tapering forward, which is provided with longitudinal ribs 14 distributed around the circumference, whose envelope surface corresponds to an envelope cylinder of the propellant cup 4, so that they taper off flat toward the rear end of the jacket 10, as may be inferred from FIG. 2 in particular. A good guide of the propellant cup 4, which is driven with the aid of the propellant gases out of a barrel of a shotgun, for example, is ensured by these longitudinal ribs 14 in spite of the jacket surface 13 tapering forward, which makes the passage of the propellant cup 4 and the projectile 5 through a possibly constricted muzzle opening of the barrel easier. Because the propellant cup 4 is to separate from the projectile 5, which flies further, after the propellant cup 4 is driven out of the barrel, separation points 15 in the form of axial slots are provided distributed around the circumference of the jacket 10 of the propellant cup 4, so that the jacket 10 spreads apart like an umbrella and is decelerated after the exit from the barrel because of the air resistance. These separation points 15, which may also be implemented as intended breakpoints, also may not impair the seal between the jacket 10 of the propellant cup 4 and the barrel, of course, because the expulsion force is a function of this seal. Therefore, if the separation points 15 are extended axially to the rear beyond a preferably provided seal ring 16, as indicated in FIGS. 2 and 4, a seal closed around the circumference is ensured by the axial seal sections 17 enclosing the rear end of the separation points 15.

The projectile 5 forms a setback annular shoulder 19 on its head 18, which is overlapped by the jacket 10 of the propellant cup 4. The projectile 5 is thus axially fixed in the propellant cup 4 and may be inserted together with the propellant cup 4 in the cartridge casing 1. The retention of the propellant cup 4 together with the projectile 5 in the cartridge casing 1 is achieved in a typical manner by a folded-over edge 20 of the cartridge casing 1, as may be inferred from FIG. 1. The axial support of the jacket 10 of the propellant cup 4 on the annular shoulder 19 of the projectile head 18 is not only used for axially fixing the projectile 5 within the propellant cup 4, but rather also causes relief of the jacket 10 from axial pressure forces which are incident on the jacket 10 via the propellant cup 4 impinged by the propellant gases as the projectile 5 is driven out. In this context, it is to be considered that the jacket 10 is to ensure a minimum deformation to improve the seal action between the jacket 10 and the barrel through the propellant gas pressure active in the area of the pockets 9.

In order that the propellant gas pressure may be transmitted with an advantageous damping via the propellant cup 4 to the projectile 5, the projectile 5 may be supported in the axial direction on the base of the propellant cup 4 via damping elements 21. In FIGS. 1 and 4, these damping elements 21 are provided in the form of damping ribs 22, which run transversely to the guide vanes 8 of the projectile 5.

Figure 5:
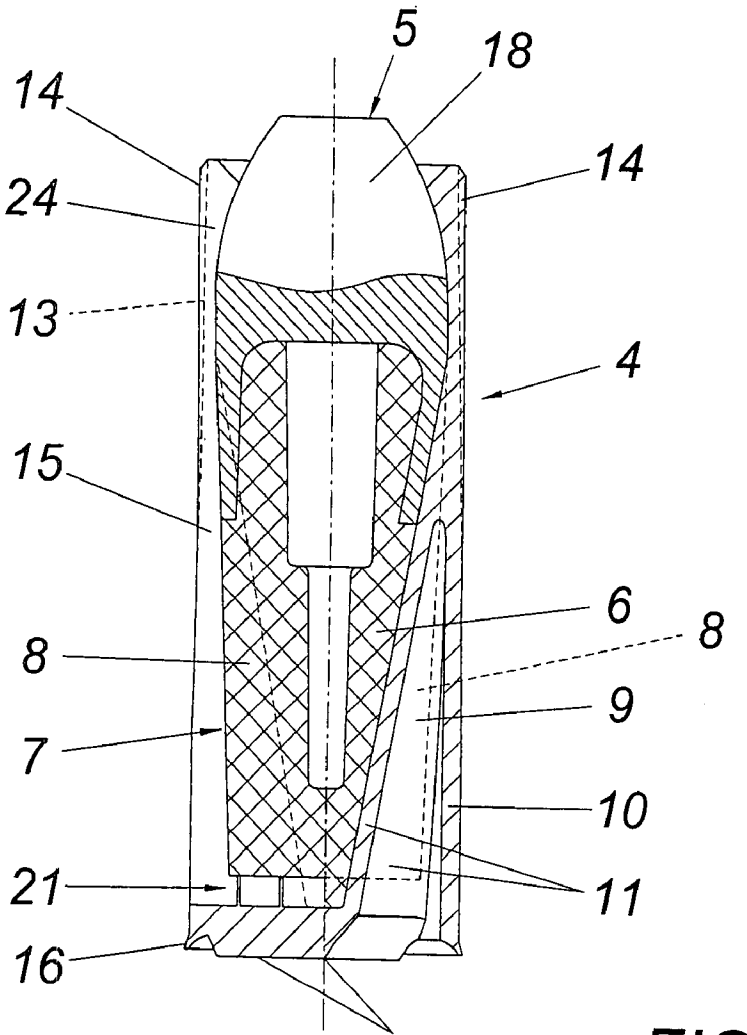
FIG. 5 shows an illustration, corresponding to FIG. 4, of an embodiment variant of a propellant cup with the associated projectile.

The embodiment according to FIG. 5 differs from that according to FIGS. 1 through 4 above all in that the jacket 10 of the propellant cup 4 extends essentially over the entire length of the propellant cup 4, which causes the disadvantage of a smaller receptacle volume for the propellant charge in comparison to inner walls 11 projecting axially beyond the jacket 10 according to the exemplary embodiment from FIGS. 1 through 4, but has the advantage of obtaining a continuous guide of the propellant cup 4 in the barrel over the axial length of the propellant cup 4, without having to provide additional design measures for this purpose. According to FIGS. 1 through 4, the inner walls 11 carry guide ribs 23 projecting beyond the jacket 10 in the axial direction in extension of the jacket 10 for this purpose. These guide ribs 23 are also used as seal sections 17 in the illustrated construction. The projectile 5 corresponding to FIG. 5 is also equipped with a tail unit 7 forming guide vanes 8. The projectile head 18 does not have an annular shoulder 19, however. The axial fixing of the projectile 5 in the propellant cup 4 is performed by a concave inner wall 24 of the propellant cup jacket 10 which overlaps the convex head 18.

Figure 6:
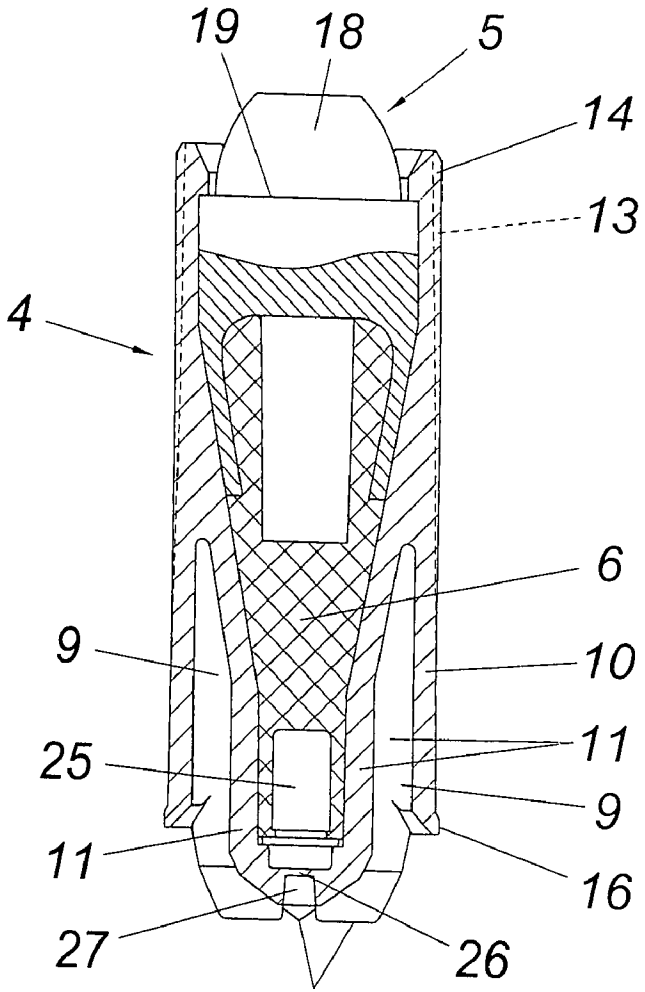
FIG. 6 shows a further embodiment of a propellant cup with a projectile in a simplified longitudinal section.

The projectile 5 according to FIG. 6 is provided with a tracer unit 25, but otherwise essentially corresponds to that according to FIGS. 1 through 4. To ignite the tracer unit 25, the propellant cup 4 forms an overflow channel 27 closed by a diaphragm 26 for the propellant gases, which break through the diaphragm 26 when impinging the propellant cup 4 and ensure ignition of the tracer unit 25.

Figure 7:
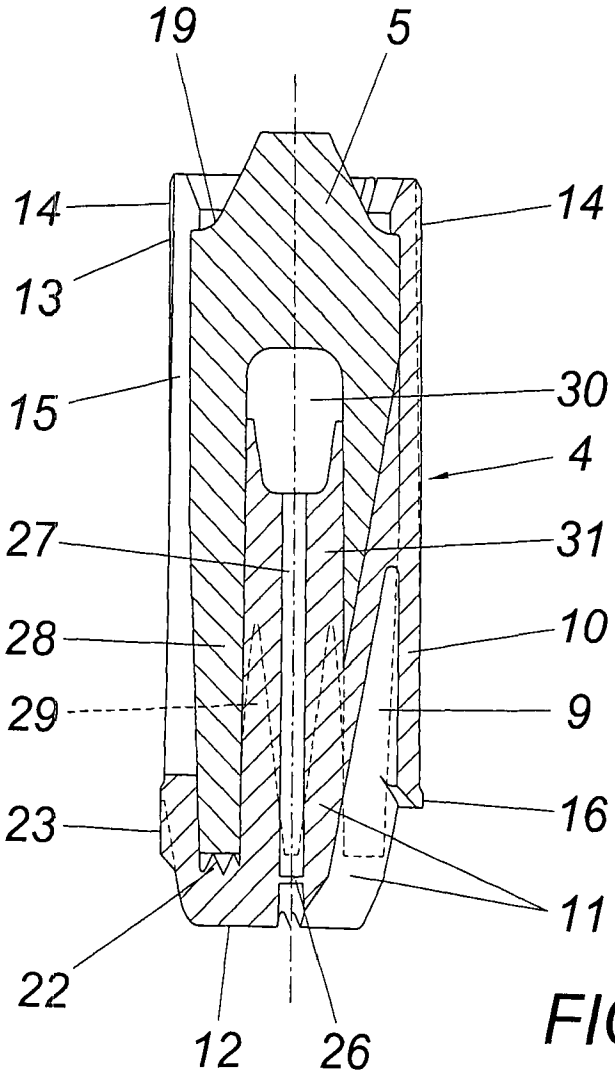
FIG. 7 shows an additional embodiment of the projectile with a propellant cup in an illustration corresponding to FIG. 4.

The projectiles 5 may be tailored and designed in manifold forms for various conditions, as illustrated in FIGS. 7 through 16 in several exemplary embodiments. The propellant cup 4 is to be tailored in each case to the projectile shape. Thus, FIG. 7 shows a projectile 5 which is formed by a hollow rotating body and obtains its flight guiding by mantle recesses 29 originating from the base-side face of the projectile jacket 28, through which the pockets 9 of the propellant cup 4 extend. In addition, an extension 31 of the propellant cup 4 having an overflow channel 27 which opens into the cavity 30 of the projectile 5 projects into the base-side cavity of the projectile. Because the overflow channel is again closed using a diaphragm 26, upon a pressure infringement of the propellant cup 4 by the propellant gases, the diaphragm 26 is again broken through, so that a corresponding gas pressure may build up in the cavity 30 as the projectile 5 is driven out of a barrel, which supports the detachment of the propellant cup 4 from the projectile 5, which flies further, after the propellant cup 4 exits from the barrel.

Figure 8:
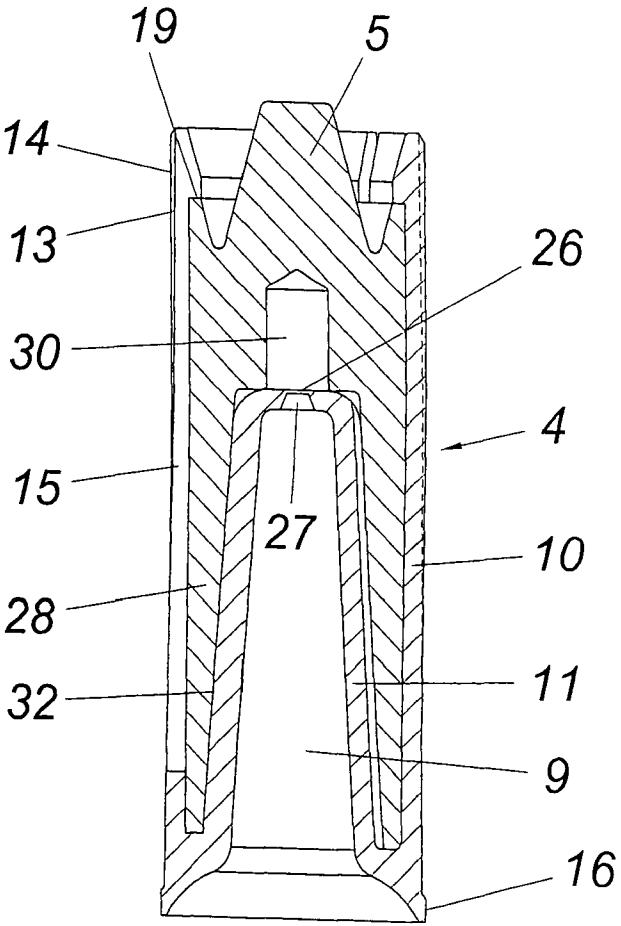
FIG. 8 shows a further design form of a projectile in a propellant cup in a longitudinal section corresponding to FIG. 4.

According to FIG. 8, a projectile 5 which is cylindrical in its basic shape is provided, which has a centric recess 32 in the projectile base, into which a pocket 9 of the propellant cup 4 extends. The base of the pocket 9 is provided with an overflow channel 27 enclosed by a diaphragm 26, which opens into a cavity 30 of the projectile 5 adjoining the recess 32, to be able to use the gas pressure building up in the cavity 30 after the diaphragm 26 is broken through to detach the propellant cup 4 from the projectile 5, as soon as the propellant cup 4 exits with the projectile 5 from the barrel. Because there is only a friction lock between the jacket 10 of the propellant cup 4 and the projectile 5 around the circumference as a result of the cylindrical jacket of the projectile 5, which is inadequate for a twist transmission from the propellant cup 4 to the projectile 5, the projectile 5 may be provided with axial ribbing extending around the circumference.

Figure 9:
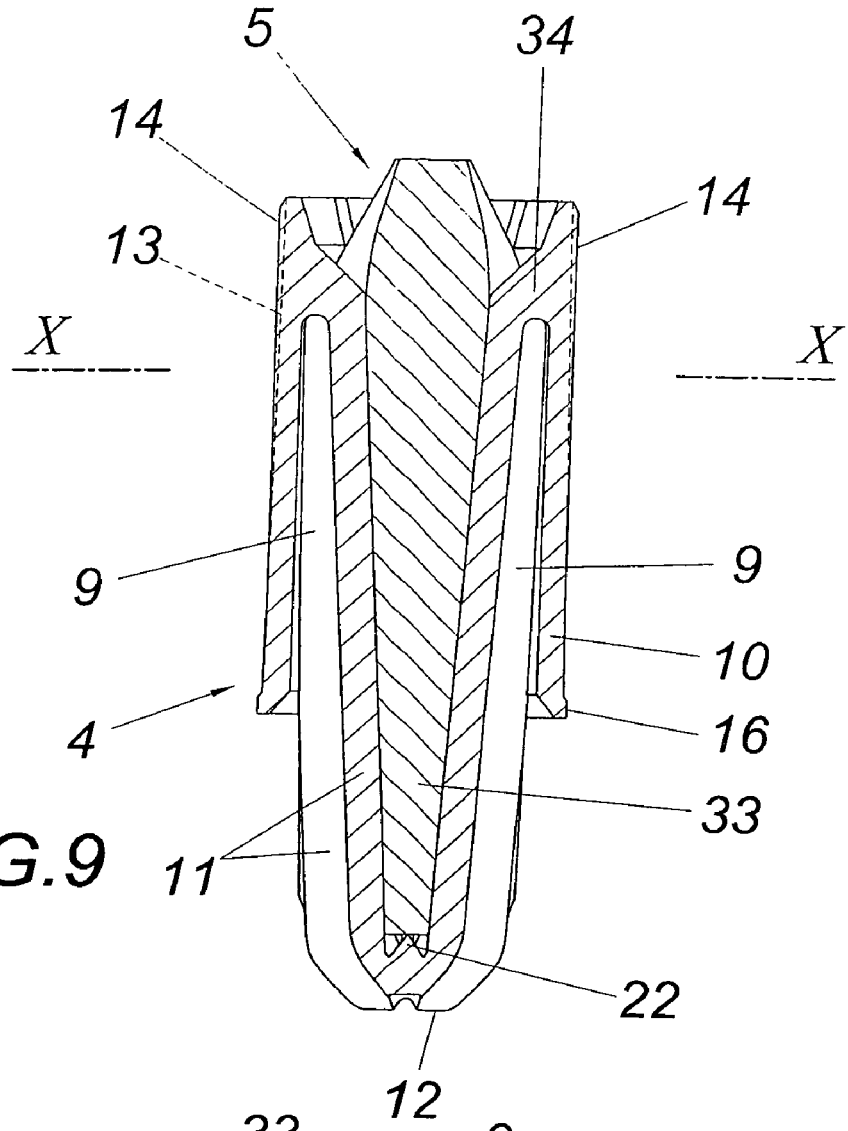
FIG. 9 shows a further alteration of a projectile with an associated propellant cup in a longitudinal section.
Figure 10:
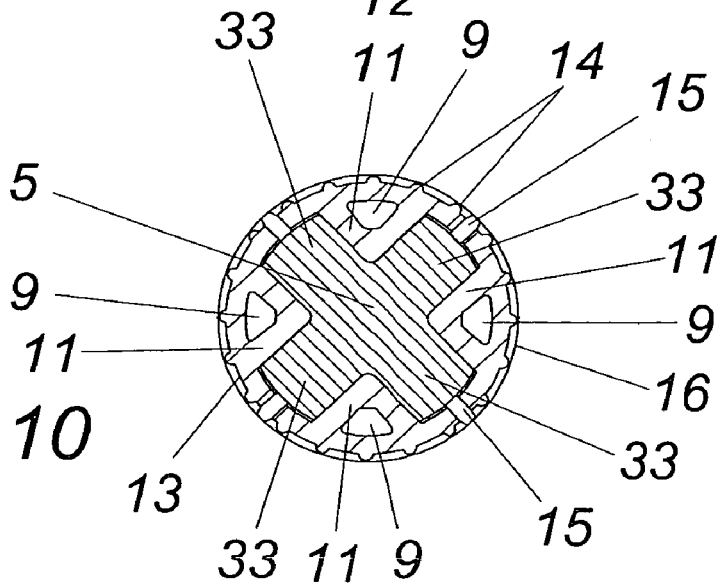
FIG. 10 shows a section along line X-X of FIG. 9.

The embodiment according to FIGS. 9 and 10 discloses a projectile 5 which has a star-shaped cross-section, which represents a continuous tail unit over the projectile length. The pockets 9 of the projectile cup 4 accordingly engage in the groin area between the star-shaped wings 33 of the projectile 5. The pocket base 34 is implemented as reinforced, however, so that the impingement pressure by the propellant gases may be absorbed by the propellant cup 4, which may only be supported at its rear end on the star-shaped wings 33 of the projectile 5.

Figure 11:
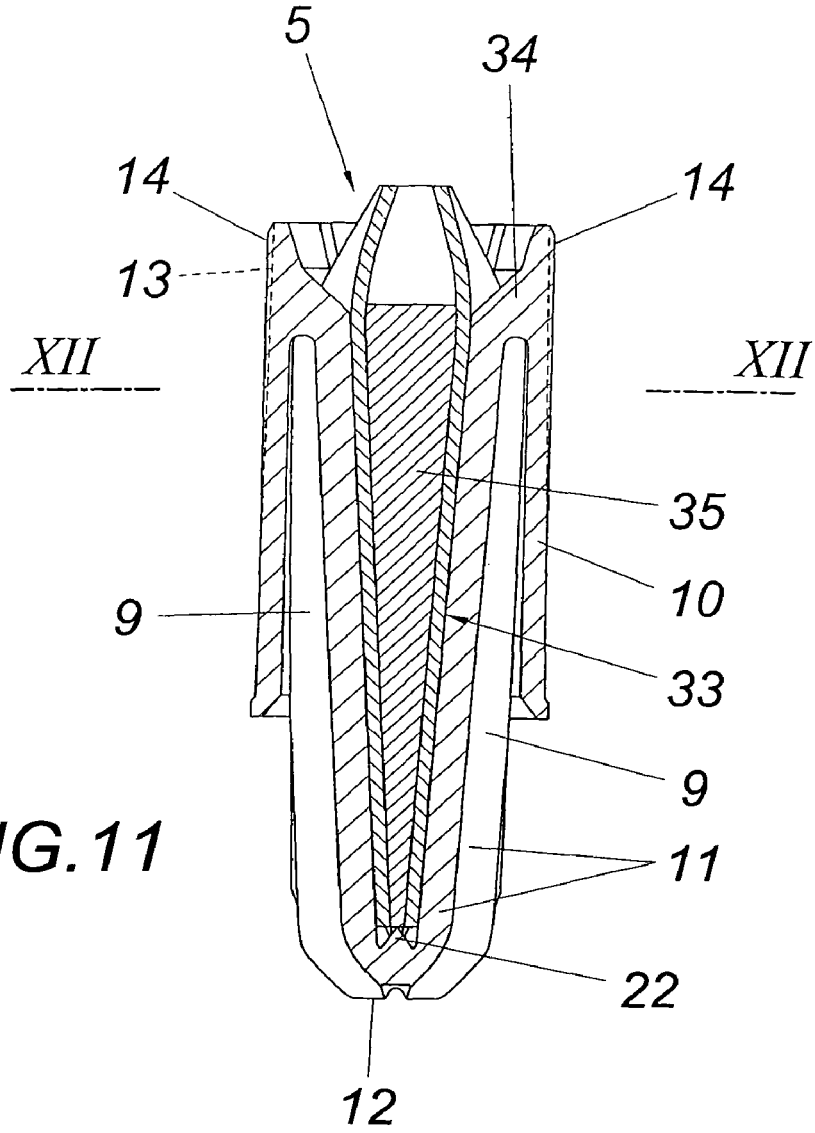
FIG. 11 shows a further embodiment of the projectile with an associated projectile cup in longitudinal section.
Figure 12:
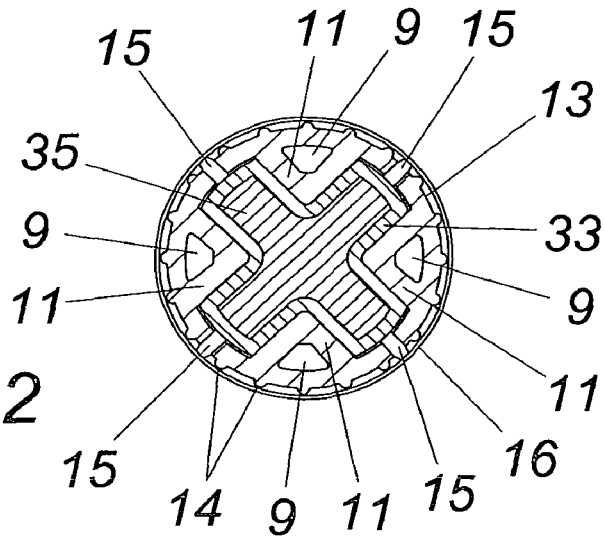
FIG. 12 shows a section along line XII-XII of FIG. 11.

The projectile according to FIGS. 11 and 12 differs from that according to FIGS. 9 and 10 above all in that it was manufactured from a tubular body, which was folded radially inward to form the axial wings 33, as may be inferred from FIG. 12 in particular. The external shape of the projectile 5 thus corresponds to that according to FIGS. 9 and 10, so that a corresponding propellant cup 4 also results. To increase the weight of the projectile 5, which solely consists of the folded-in tubular body, the remaining cavity of the folded-in tubular body may be filled up by a metal 35.

Figure 13:
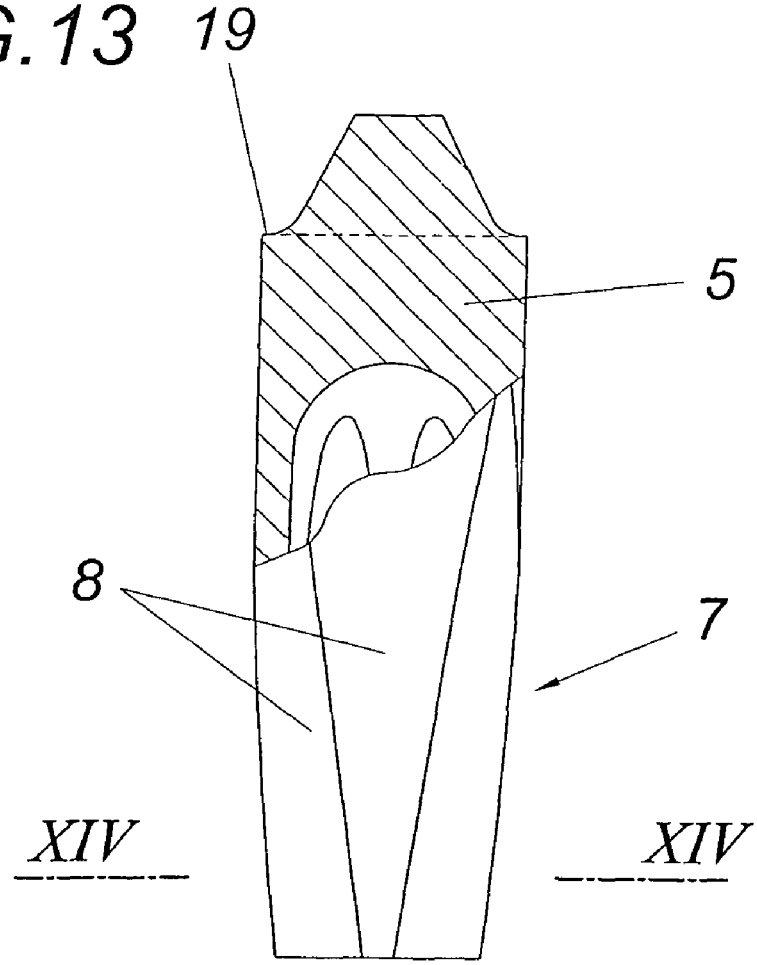
FIG. 13 shows a projectile having a tail unit in a partially cutaway side view.
Figure 14:
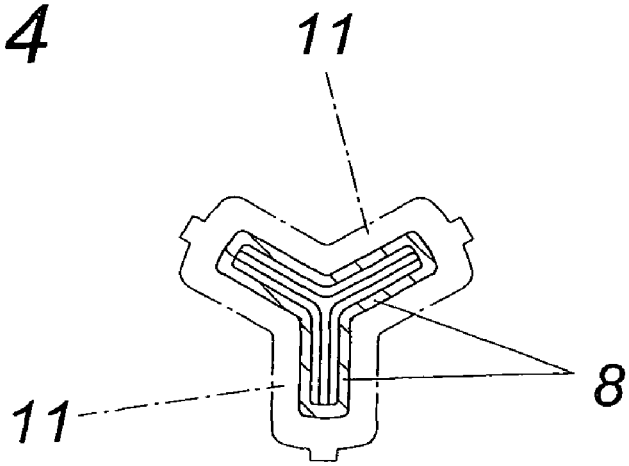
FIG. 14 shows the projectile from FIG. 13 in a section along line XIV-XIV of FIG. 13.

To produce a projectile form having a tail unit 7 made of guide vanes 8, one may began with a hollow body open toward the propellant cup 4, which is folded in to form guide vanes 8 as shown in FIGS. 13 and 14, into three guide vanes 8 according to the exemplary embodiment. In FIG. 14, these folded-in guide vanes 8 are illustrated, the inner walls 11 of the propellant cup 4 delimiting the pockets 9 being indicated by dot-dash lines. Especially simple design conditions result, however, if such a projectile 5 is not manufactured in one piece, but rather comprises a head 18 and a tail unit 7 inserted into the hollow head 18, whose guide vanes 8 extend up into the head area, as illustrated in FIGS. 4 through 6, for example. To connect the head 18 to the tail unit 7, the head 18 solely has to be folded clamped into the groin area between the guide vanes 8, a continuous shape of the guide vanes 8 from the projectile head 18 to the tail unit 7 resulting. This two-part embodiment of the projectile 5 allows the use of different projectile heads 18 with a corresponding tail unit 7 in each case.

Figure 15:
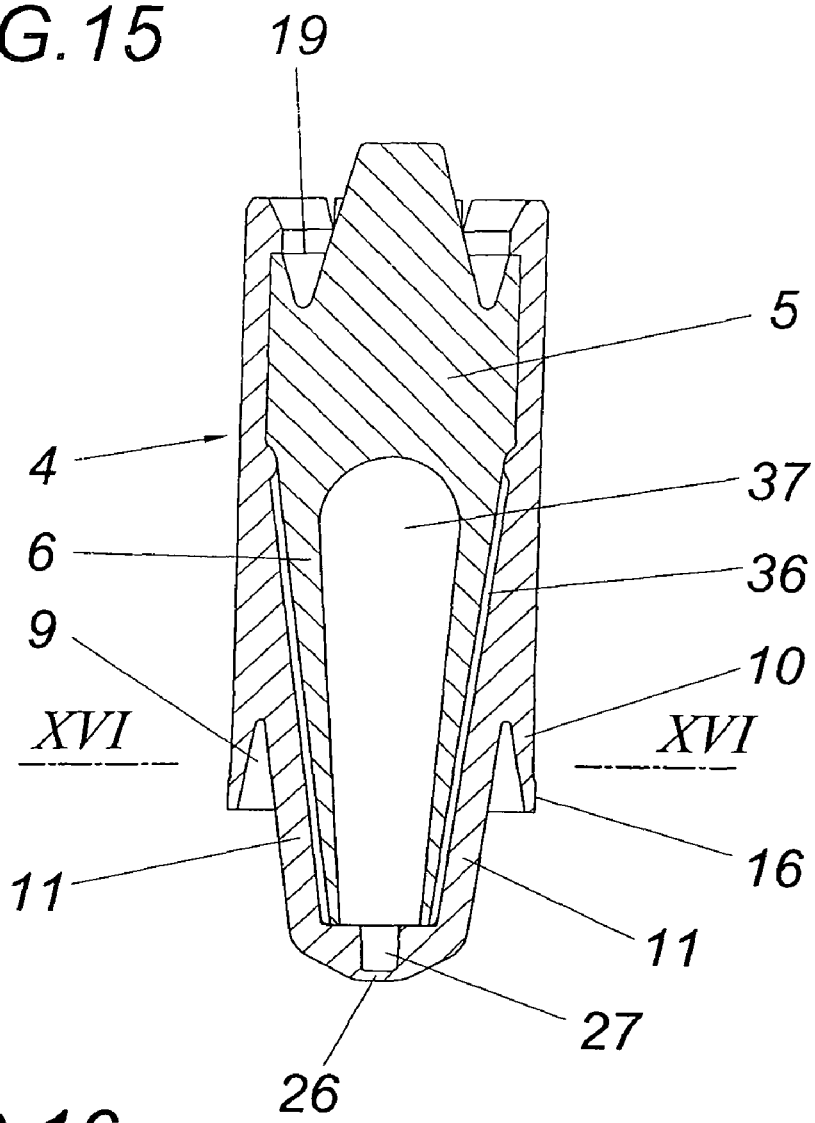
FIG. 15 shows a further projectile form having a propellant cup in an axial section.
Figure 16:
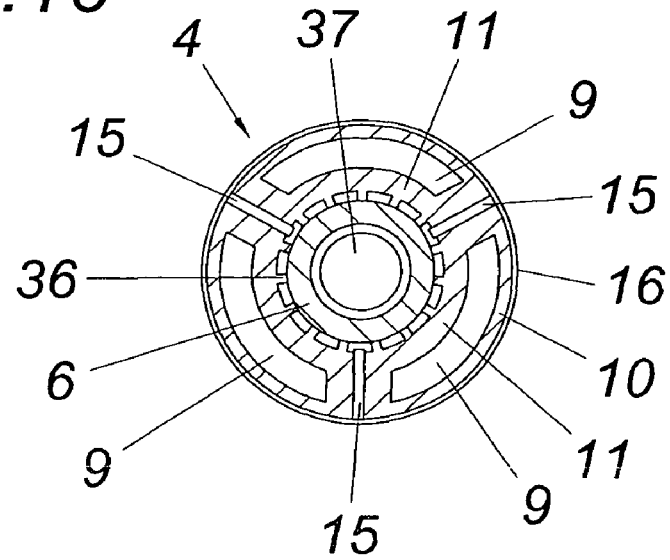
FIG. 16 shows a section along line XVI-XVI of FIG. 15.

If a tail unit is dispensed with in the projectile implementation and a projectile 5 conically tapering toward its base as shown in FIGS. 15 and 16 is used, the annular chamber resulting between this projectile 5 and the jacket 10 of the propellant cup 4 may be used as the receptacle pocket 9 for receiving a part of the propellant charge. This annular chamber may experience a subdivision through the axial longitudinal slots of the separation points 15, as may be inferred from FIG. 16. The pockets 9 may not have any passage points to the outside in the area of the jacket 10. Such a projectile 5 offers a comparative storage volume using its central cavity 37 to fire a resource to the target.

In order that the propellant cup 4 may detach more easily from the projectile 5, a continuous flat contact of the projectile body on the jacket 10 of the propellant cup may be dispensed with and the propellant cup 4 may be provided with axial ribbing 36, as illustrated in FIGS. 15 and 16, for example.

The invention claimed is:

1. A cartridge comprising:

(a) a cartridge casing comprising a base;

(b) a propellant cup manufactured from plastic and inserted in the cartridge casing, said propellant cup comprising a jacket having axial separation points along the jacket;

(c) a sub-caliber projectile received within the propellant cup in a formfitting manner;

(d) a propellant charge disposed in the cartridge casing and separated from the projectile by the propellant cup; and (e) a cavity between the projectile and the cartridge casing;

wherein the propellant cup comprises at least one pocket for receiving a part of the propellant charge, said at least one pocket extending into the cavity between the projectile and the cartridge casing, being open toward the base of the cartridge casing, and being delimited on one side by at least one inner wall of the propellant cup, the at least one inner wall pressing against the projectile and extending alongside the projectile in an axial direction.

2. The cartridge according to claim 1, wherein the at least one pocket comprises a plurality of pockets extending between axial guide vanes of the projectile.

3. The cartridge according to claim 2, wherein the projectile comprises a hollow body open toward the propellant cup and folded into the guide vanes.

4. The cartridge according to claim 2, wherein the at least one inner wall comprises inner walls delimiting the pockets of the propellant cup and tapering off into a cutting edge toward the propellant charge.

5. The cartridge according to claim 4, wherein the inner walls delimiting the pockets of the propellant cup project in an axial direction beyond the jacket of the propellant cup toward the base of the cartridge casing and carry axial guide ribs in extension of the jacket.

6. The cartridge according to claim 5, wherein the projectile is supported in the axial direction via damping elements on a propellant cup base of the propellant cup.

7. The cartridge according to claim 6, wherein the propellant cup has a propellant cup floor and the damping elements comprise damping ribs provided on the propellant cup floor of the propellant cup and projecting toward the projectile.

8. The cartridge according to claim 2, wherein the pockets of the propellant cup are partially filled with a damping compound.

9. The cartridge according to claim 1, further comprising a further pocket, wherein the projectile has a projectile base with a centric recess and the further pocket extends into the centric recess in the projectile base.

10. The cartridge according to claim 1, wherein the at least one pocket comprises an annular chamber, enclosing the projectile and tapering conically toward a propellant cup base of the propellant cup.

11. The cartridge according to claim 1, wherein the jacket has a tapering jacket surface having circumferentially-distributed longitudinal ribs and comprising an envelope surface corresponding to an envelope cylinder of the propellant cup.

12. The cartridge according to claim 1, wherein the projectile comprises a setback annular shoulder, overlapped by the propellant cup, on a head of the projectile.

13. The cartridge according to claim 1, wherein the propellant cup has at least one diaphragm, which closes an overflow channel to the projectile and is broken through by propellant gas pressure from the propellant charge.

14. The cartridge according to claim 13, wherein the projectile comprises an adjoining cavity adjoining the overflow channel.

15. The cartridge according to claim 1, wherein the projectile comprises a hollow head in a head area, a tail unit inserted into the hollow head, and guide vanes extending up into the head area, wherein the hollow head is folded and clamped into a groin area between the guide vanes.

16. The cartridge according to claim 1, wherein the projectile has a star-shaped cross-section.

17. The cartridge according to claim 16, wherein the projectile comprises a tubular body, which is folded radially inward to form axial wings.

18. The cartridge according to claim 1, wherein the propellant cup has at least one peripheral seal ring.

* * * * *